United States Patent [19]

Carroll et al.

[11] 4,210,314

[45] Jul. 1, 1980

[54] HYDRAULIC JACK

[76] Inventors: Herbert J. Carroll, 7729 Alto Caro Dr., Dallas, Tex. 75248; Thomas C. Davis, Sr., 11214 Carissa Dr., Dallas, Tex. 75218

[21] Appl. No.: 946,951

[22] Filed: Sep. 29, 1978

[51] Int. Cl.[2] ..... B66F 5/04

[52] U.S. Cl. ..... 254/8 B

[58] Field of Search ..... 254/8 B, 2 B, 124, 93 R

[56] References Cited

U.S. PATENT DOCUMENTS

| | | | |
|---|---|---|---|
| 2,528,329 | 10/1950 | Bauer | 254/124 |
| 2,575,160 | 11/1951 | Clarke | 254/124 |
| 2,814,394 | 11/1957 | Witcher | 254/124 |
| 3,362,168 | 1/1968 | Dotlich | 254/93 R |
| 4,131,263 | 12/1978 | John | 254/8 B |

*Primary Examiner*—Robert C. Watson

*Attorney, Agent, or Firm*—Hubbard, Thurman, Turner, Tucker & Glaser

[57] ABSTRACT

A hydraulic jack of the type typically employed for automotive repair work is equipped with a frame supported on wheels, a hydraulic unit for powering the jack, and an elevator mechanism for raising a lift plate in response to a ram actuated by the hydraulic unit. The hydraulic unit is supported in the frame without bolts or other fastening devices and thus is easily removable for repair or replacement. The elevator mechanism includes pivotable elevator arms for raising a roller which travels along an S-shaped lever. The lever supports the lift plate at one end and is pivoted in the frame at its other end.

17 Claims, 6 Drawing Figures

FIG. 3
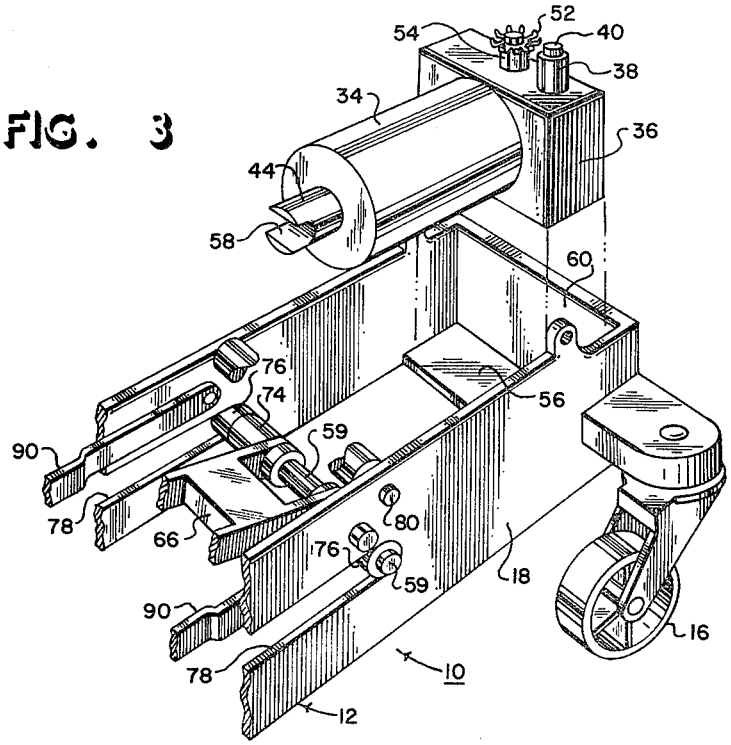
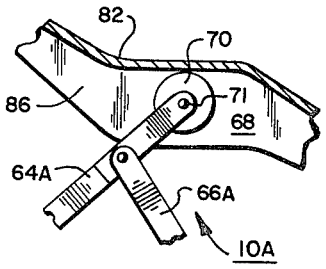
FIG. 6
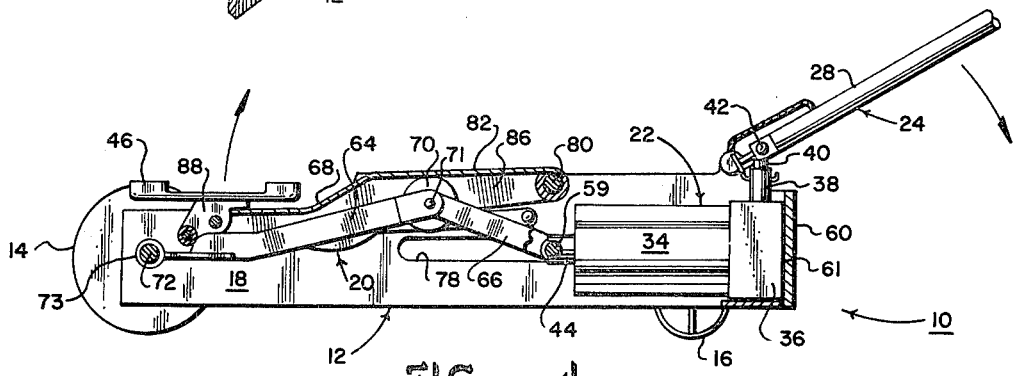
FIG. 4
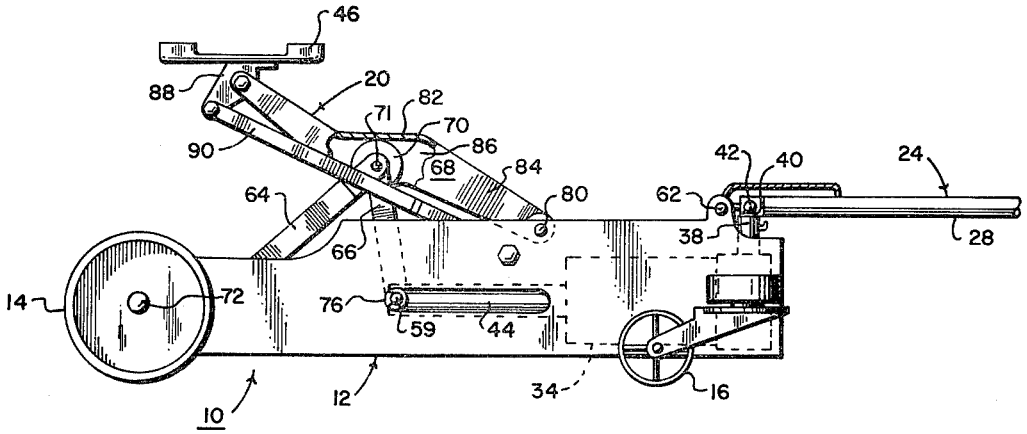
FIG. 5

HYDRAULIC JACK

The present invention pertains generally to lifting devices and particularly to hydraulic floor jacks of the type employed for lifting automobiles and the like.

A common problem with hydraulic jacks is the tendency for the hydraulic unit to have a relatively short life in service, thus requiring frequent maintenance. Heretofore, hydraulic floor jacks of the prior art have necessitated a rather time consuming procedure for replacing a worn hydraulic unit with a new or refurbished unit. Thus, it would be desirable to provide a hydraulic floor jack capable of being repaired quickly in the event of a hydraulic unit breakdown.

Accordingly, it is a principal object of the present invention to provide a hydraulic floor jack having a frame equipped to retain a hydraulic unit in place during operation without mounting bolts or similar fasteners. In a presently preferred embodiment of the invention, a lower horizontal surface of the hydraulic unit merely rests on a transverse frame member so that the hydraulic unit can be lifted out of the frame without complicated disassembly when repair or replacement of the hydraulic unit becomes necessary. The entire replacement procedure can be completed in a matter of seconds. During operation, the load-lifting force of the hydraulic unit is counteracted by another transverse frame member that abuts a rearward vertical surface of the hydraulic unit.

It is another object of the present invention to provide an improved mechanism for lifting or elevating a load upon activation of the hydraulic unit. The mechanism includes a plurality of intercoupled arms that provide superior load-lifting capacity while employing a more compact frame construction.

Additional objects, advantages and novel features of the present invention may be best understood by reference to the following detailed description of an illustrative embodiment when read in conjunction with the accompanying drawings, wherein:

FIG. 3 is a fragmentary perspective view illustrating a hydraulic unit exploded out above its mounting position in a rearward portion of the jack;

FIG. 4 is a longitudinal sectional view of the jack wherein the lifting mechanism is in the fully lowered position;

FIG. 5 is a side elevational view of the jack wherein the lifting mechanism is in the fully raised position; and FIG. 6 is a fragmentary side view of a modified lifting mechanism in accordance with the present invention.

Referring now to the drawings, a presently preferred embodiment of the invention will be described in detail, like reference numerals designating like parts in the various figures.

Figure 1:
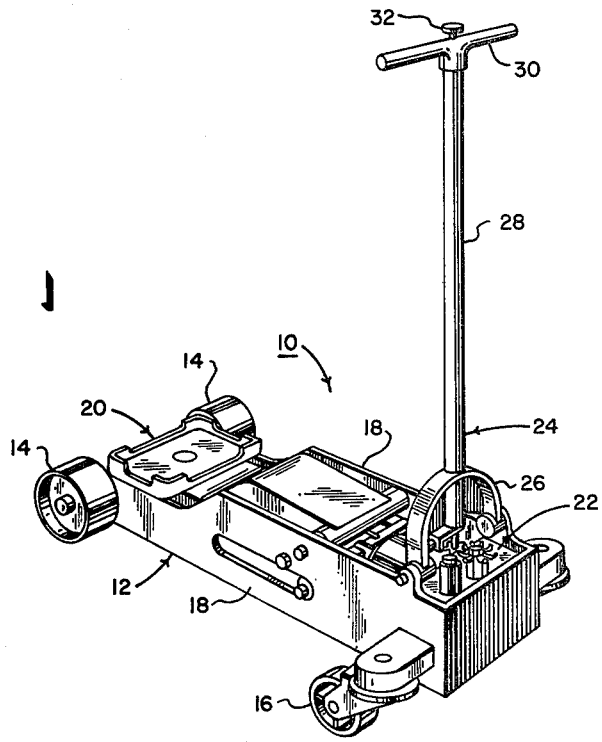
FIG. 1 is a perspective view of a hydraulic floor jack in accordance with the present invention wherein a lifting mechanism of the jack is in a fully lowered position.

With particular reference to FIG. 1, a hydraulic jack of the present invention is designated generally by reference numeral 10. The jack 10 is constructed in an elongated frame 12 which is carried forwardly by two principal load bearing wheels 14 and rearwardly by two castored wheels 16. The frame 12 includes longitudinal side plates or support members 18 within which are mounted a lifting or elevator mechanism 20 and a hydraulic unit 22. A handle assembly 24 is pivotally connected rearwardly in the frame 12 above the hydraulic unit 22. The handle assembly 24 includes a yoke 26 which houses elements for actuating the hydraulic unit 22 in a manner to be more fully described below. An elongated tubular shaft 28 extends from the yoke 26 to a T-shaped handle 30 which is employed by the operator to position the jack 10 under the vehicle or other load to be lifted and then to pump the hydraulic unit 22 which in turn raises the elevator mechanism 20, thus lifting the load. Disposed outwardly from the handle 30 is a control knob 32 which communicates through the shaft 28 to deactuate the hydraulic unit 22 and thus lower the load.

Figure 2:
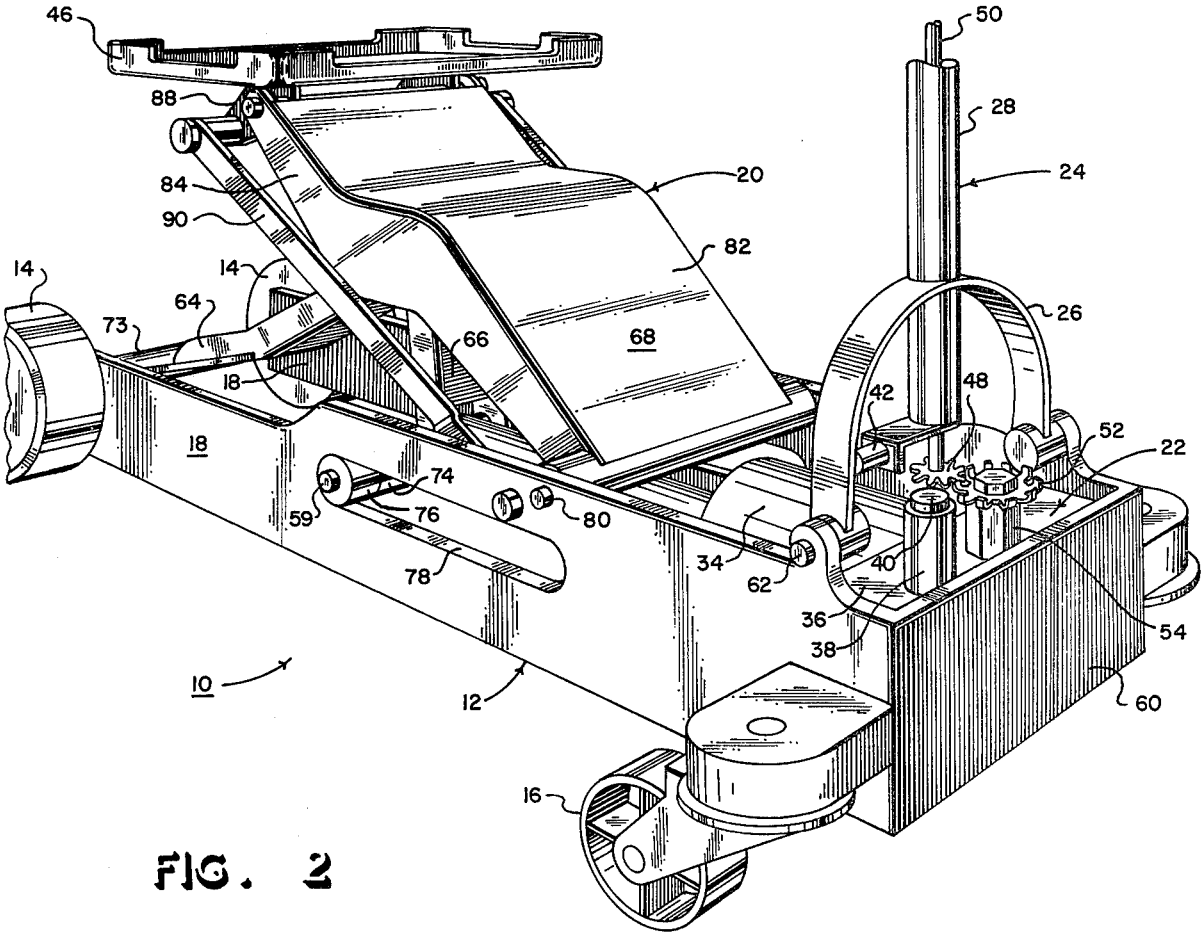
FIG. 2 is a perspective view of the jack wherein the lifting mechanism is in a fully raised position.

The manner in which the handle assembly 24 cooperates with the hydraulic unit 22 is depicted more clearly in the enlarged view of FIG. 2. The hydraulic unit 22 includes a conventional hydraulic cylinder 34 horizontally disposed in the frame 12 and supported rearwardly therein by a rectangular block 36. The block 36 houses a hydraulic reservoir, hydraulic fluid passageways and cooperating valves, none of which are specifically illustrated in as much as they are essentially conventional in construction and operation. Examples of typical hydraulic mechanisms are described in the following references: Mueller, U.S. Pat. No. 2,629,583; Butorac, U.S. Pat. No. 3,807,694; and Tallman, U.S. Pat. No. 4,018,421. Mounted atop the block 36 is a pump cylinder 38 having a plunger 40 which is actuated by a roller 42 carried by the handle assembly 24 within the yoke 26.

Referring briefly to FIGS. 4 and 5, the plunger 40 is actuated by repetitively pumping the handle assembly 24 through a relatively short stroke. In particular, FIG. 4 depicts the roller 42 in position to engage the plunger 40 as the shaft 28 is lowered as indicated by the adjacent arrow. When the shaft 28 is brought into the horizontal position depicted in FIG. 5, the roller 42 depresses the plunger 40 to pump hydraulic fluid from the reservoir in the block 36 into the main hydraulic cylinder 34. One pump stroke is completed when the shaft 28 is raised to an angle sufficient for the roller 42 to become disengaged from the plunger 40. Such angle is preferably about 20 degrees above the horizontal, so that, if necessary, the shaft 28 can extend partially under the load to be lifted. Repetitive pump strokes gradually cause a ram 44 to be extended horizontally from the main cylinder 34 which in turn causes the elevator mechanism 20 to raise a lift plate or saddle 46 from a lowered position as seen in FIG. 4 to a raised position as seen in FIG. 5.

Referring again to FIGS. 1 and 2, lowering the elevator 20 and saddle 46 is accomplished using the aforementioned control knob 32 which rotatably communicates with a gear 48 by means of a rod 50 disposed within the tubular shaft 28. The gear 48 cooperatively engages a second gear 52 rotatably disposed on a casing 54 mounted on the block 36. The second gear 52 drives a conventional valve stem within the casing 54 to open a release valve (not shown) which permits hydraulic fluid to return from the main cylinder 34 to the reservoir within the block 36, thereby allowing the elevator 20 and the saddle 46 to collapse from the raised position seen in FIG. 2 to the lowered position seen in FIG. 1.

In accordance with an important feature of the jack 10, the hydraulic unit 22 is supported in the frame 12 without being secured or fastened therein, thereby facilitating quick removal of the hydraulic unit 22 in the manner depicted by FIG. 3. In particular, the hydraulic unit 22 rests on a transverse frame member or flange 56 interconnecting the side plates 18 at the rear of the frame 12. The leading edge of the ram 44 includes a generally U-shaped groove 58 which is adapted to slidably engage a pin 59. The force of the ram 44 engaging the pin 59 to lift the load is counteracted by another transverse frame member 60 that abuts a rearward vertical surface 61 of the hydraulic block 36 as seen in FIG. 4. Removing the hydraulic unit 22 from the frame 12 is easily accomplished by first removing the handle assembly 24 from the frame 12, then moving the pin 59 forwardly out of engagement with the ram 44 and finally lifting the hydraulic unit 22 upwards out of the frame 12 as depicted in FIG. 3. Most preferably, the handle assembly 24 is pivotally secured to the frame 12 by means of spring-loaded pins 62, seen most clearly in FIG. 2, which permit the handle assembly 24 to be quickly removed and reinstalled.

The details of the presently preferred elevator mechanism 20 will now be described with particular reference to FIGS. 4 and 5. The elevator mechanism 20 includes forward and rearward elevator arms 64 and 66 and a lever arm 68 which are intercoupled through a roller 70 to convert the horizontal movement of the ram 44 into vertical movement of the saddle 46. In the presently preferred embodiment, the roller 70 is journaled on a pin 71 that also serves as the pivotal connection for the arms 64 and 66. The forward elevator arm 64 is journaled on a pin 72 which also functions as the axle for the wheels 14. Preferably, the forward elevator arm 64 is welded or otherwise secured to a bushing 73 that also serves as a transverse brace at the forward end of the frame 12.

As depicted in FIGS. 2 and 3, the rearward elevator arm 66 is welded or otherwise secured to bushings 74 which pivot on the pin 59, and rollers 76 are journaled on the ends of the pin 59 and rolled in longitudinal slots 78 in the side plates 18. The rearward end of the lever arm 68 is journaled on a pin 80 secured in the frame 12 in a suitable manner. The lever arm 68 includes an S-shaped flange 82 and vertical sidewalls 84 and 86. The roller 70 engages the undersurface of the flange 82 during a lifting operation as depicted in FIGS. 4 and 5. As the ram 44 moves forwardly, the elevator arms 64 and 66 scissors together forcing the roller 70 upwardly thereby pivoting the lever arm 68 about the pin 80 in the direction of the arrow shown above the saddle 46 in FIG. 4. The curved or S-shaped arrangement of the flange 82 allows the saddle 46 to remain as low as possible in the fully lowered position seen in FIGS. 1 and 4. The length of the slots 78 controls the relative position of the arms 64 and 66 so that they will readily move without becoming jammed at the fully lowered and fully raised positions. For example, in the fully lowered position, the arms 64 and 66 form an angle of less than 180 degrees and preferably about 165 degrees so that the forwardly directed force of the ram 44 will cause the arms 64 and 66 to begin to scissors together causing the roller 70 to move upward. In addition, the forward most ends of the slots 78 act as a stop to prevent the rearward elevator arm 66 from reaching a vertical orientation. The maximum elevation of the arm 66 is preferably about 80 degrees above horizontal. It will be appreciated that the elevator mechanism 20 would collapse if the arm 66 were permitted to move through a vertical orientation. The saddle 46 is supported by a bracket 88 which is pivotally connected to the forward end of the lever arm 68. The saddle 46 is maintained in a generally horizontal orientation by control arms 90 pivotally connected at their opposite ends to the bracket 88 and the side plates 18, the ends of each control arm 90 and the ends of the lever arm 68 forming a parallelogram as will be appreciated by those skilled in the art.

Portions of a modified jack 10A are illustrated in FIG. 6, the non-illustrated portions being essentially the same as those previously described in the principal jack embodiment 10. The modified jack 10A comprises a rearward elevator arm 66A pivotally connected to a forward elevator arm 64A at a point along the forward elevator arm 64A rather than at the roller pin 71. It will be appreciated that in such an arrangement the forward elevator arm 64A acts as a lever to provide greater vertical lift for the same horizontal travel of the ram 44 (previously described) in comparison to that achieved by the principal jack embodiment 10.

The above-described embodiments of the invention provide additional mechanical advantages and operational improvements over the various prior art devices. For example, positioning the pump cylinder 38 and release valve casing 54 atop the block 36 permits the handle assembly 24 to be cooperatively disposed immediately over the block 36. Such an arrangement allows the frame 12 to be made comparatively shorter and thus more compact and lighter in weight. By contrast, the jack described in the aforementioned Butorac patent includes a pump cylinder extending rearwardly from a hydraulic unit, thus necessitating a substantially longer frame to accommodate mounting of the handle and interconnecting linkage for actuating the pump cylinder. On the other hand, the longer frame of the Butorac-type jack provides additional extension for reaching a more distant point of engagement beneath the load to be lifted. The jack 10 of the present invention, however, compensates for its shorter frame 12 by employing the shaft 28 of the handle assembly 24 to give the necessary extension for reaching under the load. It will be appreciated that the aforementioned pump stroke angle employed by the inventive jack 10 keeps the shaft 28 low to the ground so that it can extend under the load during pumping. Note that Butorac-type jacks employ a pump stroke that begins with the handle in a generally vertical orientation so that the handle will ordinarily not be available for extending the reach of the jack under the load.

Another advantage of the inventive jack 10 over various prior art jacks is the comparative stress reduction at critical structural points. The aforementioned Butorac and Tallman patents describe a lifting mechanism employing a lever arm wherein the driving force or hydraulic power of a longitudinally extendable ram is applied at a point on the lever arm farther removed from the load than the distance from the load to the fulcrum (i.e., the point of pivotal attachment of the lever arm to the frame). Those skilled in the art will appreciate that the stress at the fulcrum of a lever can be reduced by applying a driving force of equal magnitude at a point on the lever between the load and the fulcrum. The jack 10 of the present invention achieves such reduced stress at the pin 80, which acts as the fulcrum for the lever arm 68, since the driving force is applied by the roller 70 on the flange 82 between the saddle 46 and the pin 80. It will also be appreciated that the unique action of the roller 70 in moving forwardly along the flange 82 as the load is being lifted further reduces the stress at the pin 80 from what would be the case if the driving force were always applied at a point of closer proximity to the pin 80, such as the point where the roller contacts the flange 82 in the fully lowered position seen in FIG. 4.

A further advantage of the inventive jack 10 over prior art hydraulic floor jacks is its superior load-lifting capacity due in part to the above-mentioned stress reducing features and in part to the load-sharing effect of the elevator arms 64 and 66.

Although a preferred embodiment of the invention and a modification thereof have been described in detail, it is to be understood that additional modifications, substitutions and alternatives can be produced in accordance with the invention without departing from the spirit and scope thereof as defined by the appended claims.

What is claimed is:

1. A hydraulic jack, comprising:

a frame having spaced apart longitudinal support members and transverse brace members interconnecting the longitudinal support members;

a saddle for engaging a load to be lifted by the jack;

a hydraulic unit carried by the frame and having a longitudinally extendable ram; and an elevator mechanism including members intercoupling the saddle and the ram for converting horizontal movement of the ram into vertical movement of the saddle, the intercoupling members including forward and rearward elevator arms and a lever arm, the forward elevator arm having a first end pivotally secured in the frame and a second end rotatable about its first end, the rearward elevator arm having a first end longitudinally movable in the frame and a second end pivotally secured to the forward elevator arm at a point removed from the first end of the forward elevator arm, the first end of the rearward elevator arm being cooperatively intercoupled with the ram, the lever arm having a first end pivotally secured in the frame and a second end rotatable about its first end, the second end of the lever arm being cooperatively intercoupled with the saddle, the elevator mechanism further including a roller for intercoupling the forward elevator arm and the lever arm to translate vertical movement of the second end of the forward elevator arm into corresponding vertical movement of the saddle, the roller being journaled at the second end of the forward elevator arm for engaging a surface of the lever arm, whereby the lifting force of the jack is transferred from the ram to the saddle via the elevator arms, the roller and the lever arm.

2. The hydraulic jack of claim 1 wherein the first end of the lever arm is pivotally secured in the frame at a point rearward from the location of the roller, the lever arm including a flange extending forwardly in overlying engagement with the roller, the flange being shaped to allow the saddle to be supported at a point below the point of engagement of the roller with the flange when the elevator mechanism is in the fully lowered position.

3. The hydraulic jack of claim 1 wherein the rearward elevator arm is pivotally secured to the forward elevator arm by a pin that also serves as an axle for the roller.

4. The hydraulic jack of claim 1 wherein the second end of the rearward elevator arm is pivotally secured to the forward elevator arm at a point between the first and second ends of the forward elevator arm, whereby the forward elevator arm works as a lever.

5. The hydraulic jack of claim 1 further comprising a first pair of wheels rotatably mounted at the forward end of the frame and a second pair of wheels rotatably mounted at the rearward end of the frame, the first pair of wheels having a common axle extending between the sidewalls of the frame, the axle serving as the pivotal support for the first end of the forward elevator arm.

6. The hydraulic jack of claim 1 further comprising means for guiding the longitudinal movement of the first end of the rearward elevator arm, the guiding means including means for preventing the rearward elevator arm from reaching a vertical orientation as the ram is extended.

7. A hydraulic jack, comprising:

a frame having spaced apart longitudinal sidewalls and transverse brace members interconnecting the sidewalls;

a saddle for engaging a load to be lifted by the jack;

a hydraulic unit carried by the frame and having a longitudinally extendable ram;

an elevator mechanism including members intercoupling the saddle and the ram for converting horizontal movement of the ram into vertical movement of the saddle, the intercoupling members including forward and rearward elevator arms and a lever arm, the forward elevator arm having a first end pivotally secured in the frame and a second end rotatable about its first end, the rearward elevator arm having a first end longitudinally movable in the frame and a second end pivotally secured to the forward elevator arm at a point removed from the first end of the forward elevator arm, the first end of the rearward elevator arm being cooperatively intercoupled with the ram, the lever arm having a first end pivotally secured in the frame and a second end rotatable about its first end, the second end of the lever arm being cooperatively intercoupled with the saddle, the elevator mechanism further including means for coupling the forward elevator arm and the lever arm to translate vertical movement of the second end of the forward elevator arm into corresponding vertical movement of the saddle; and a first pair of wheels rotatably mounted at the forward end of the frame and a second pair of wheels rotatably mounted at the rearward end of the frame, the first pair of wheels having a common axle extending between the sidewalls of the frame, the axle serving as the pivotal support for the first end of the forward elevator arm.

8. The hydraulic jack of claim 7 wherein the second end of the rearward elevator arm is pivotally secured to the forward elevator arm at a point between the first and second ends of the forward elevator arm, whereby the forward elevator arm works as a lever.

9. The hydraulic jack of claim 7 further comprising means for guiding the longitudinal movement of the first end of the rearward elevator arm, the guiding means including means for preventing the rearward elevator arm from reaching a vertical orientation as the ram is extended.

10. The hydraulic jack of claim 7 wherein the elevator arms are disposed at an angle relative to each other and are adapted to pivot in opposite directions to progressively reduce the magnitude of said angle as the ram is progressively extended during a load lifting operation, whereby the stress exerted on the frame by the elevator arms is progressively reduced as the load is progressively raised.

11. A hydraulic jack comprising:

a frame having first and second longitudinal support members interconnected in spaced-apart side-by-side relationship;

a saddle for engaging a load to be lifted by the jack;

a hydraulic unit carried rearwardly in the frame, the hydraulic unit having a block for housing a reservoir of hydaulic fluid, a main hydraulic cylinder forwardly connected to the block, and a ram horizontally extendable in the forward direction from the main hydraulic cylinder;

means for selectively actuating the hydraulic unit to forcibly extend the ram when the hydraulic unit is disposed in a predetermined operating position in the frame;

an elevator mechanism carried by the frame and engageable with the ram for converting the horizontal movement of the ram into vertical movement of the saddle in response to the operation of the actuating means; and means secured in the frame for supporting the hydraulic unit in its predetermined operating position solely by abutting contact with surface portions of the hydraulic unit without attachment to said surface portions, said supporting means including a first member for abutting a surface of the hydraulic unit to support the weight of the hydraulic unit and a second member for abutting a surface of the hydraulic unit to prevent rearward movement of the hydraulic unit while the ram forcibly engages the elevator mechanism during operation of the jack to lift a load.

12. A hydraulic jack comprising:

a frame having first and second longitudinal support members interconnected in spaced-apart, side-by-side relationship;

a saddle for engaging a load to be lifted by the jack;

a hydraulic unit carried rearwardly in the frame, the hydraulic unit having a block for housing a reservoir of hydraulic fluid, a main hydraulic cylinder forwardly connected to the block, and a ram horizontally extendable in the forward direction from the main hydraulic cylinder;

means for selectively actuating the hydraulic unit to forcibly extend the ram when the hydraulic unit is disposed in a predetermined operating position in the frame;

an elevator mechanism carried by the frame and engageable with the ram for converting the horizontal movement of the ram into vertical movement of the saddle in response to the operation of the actuating means;

means carried by the frame for providing vertical support for the hydraulic unit, said support means being disposed in abutting contact with the hydraulic unit for preventing downward movement of the hydraulic unit when in its predetermined operating position whether the hydraulic unit is actuated or deactuated while allowing upward movement of the hydraulic unit when the ram is disengaged from the elevator mechanism; and means carried by the frame for horizontally locating the hydraulic unit, said locating means being disposed in abutting contact with the hydraulic unit for preventing rearward movement of the hydraulic unit when in its predetermined operating position while allowing forward movement of the hydraulic unit when the ram is disengaged from the elevator mechanism;

whereby the hydraulic unit can be lifted out of the frame whenever the ram is disengaged from the elevator mechanism to facilitate repair or replacement of the hydraulic unit.

13. The hydraulic jack of claim 12 wherein said support means comprises a flange extending transversely between the longitudinal support members in a rearward lower portion of the frame, the flange having an upper horizontal surface for contacting a cooperating surface of the reservoir housing block to support the hydraulic unit in said predetermined operating position.

14. The hydraulic jack of claim 12 wherein said locating means comprises a transverse frame member disposed at the rearward ends of the longitudinal support members, the transverse frame member having a vertical surface for contacting a cooperating rearward vertical surface of the reservoir housing block to prevent the rearward movement of the block with respect to the frame when the ram forcibly engages the elevator mechanism.

15. The hydraulic jack of claim 12 wherein said actuating means comprises a pump cylinder mounted atop the reservoir housing block and a handle assembly pivotally secured to the frame above the block, the pump cylinder having a vertically reciprocating plunger extending out from the top of the pump cylinder for actuating the hydraulic unit, the handle assembly including means for engaging the plunger to repetitively depress the plunger and actuate the hydraulic unit when the handle assembly is repetitively lowered and raised about its pivot through a pump stroke of a predetermined angle.

16. The hydraulic jack of claim 15 wherein the handle assembly further includes an elongated handle having a fully lowered position extending horizontally rearward from the frame, and wherein the plunger is adapted to be fully depressed from its fully extended position by a pump stroke of the handle from about 20 degrees above the horizontal down through said fully lowered position.

17. The hydraulic jack of claim 15 further comprising spring-loaded pins serving to pivotally secure the handle assembly to the longitudinal support members, whereby the handle assembly can be quickly removed from the framed by depressing the pins to free the handle assembly from the longitudinal support members.

* * * * *